United States Patent [19]

Rausing et al.

[11] Patent Number: 4,720,325

[45] Date of Patent: Jan. 19, 1988

[54] METHOD FOR THE MANUFACTURE OF A MATERIAL IN THE FORM OF SHEETS OR A WEB PROVIDED WITH A WATERMARKLIKE PATTERN

[75] Inventors: Hans Rausing, Wadhurst, England; Ingvar Nilsson, Åkarp, Sweden

[73] Assignee: Svecia Antiqua SA, Fribourg, Switzerland

[21] Appl. No.: 821,341

[22] Filed: Jan. 22, 1986

[30] Foreign Application Priority Data

Jan. 24, 1985 [GB] United Kingdom ..... 8501756
Aug. 29, 1985 [GB] United Kingdom ..... 8521504

[51] Int. Cl.[4] ..... D21H 5/00

[52] U.S. Cl. ..... 162/110; 162/117; 162/140; 162/204

[58] Field of Search ..... 162/109, 110, 117, 140, 162/362, 204; 101/3 R, 23, 24, 6; 51/326

[56] References Cited

U.S. PATENT DOCUMENTS

| | | | |
|---|---|---|---|
| 159,516 | 2/1875 | LaMonte et al. | 162/110 |
| 1,883,526 | 10/1932 | Bryan | 162/362 |
| 4,462,866 | 7/1984 | Tooth et al. | 162/110 |

*Primary Examiner*—Peter Chin
*Attorney, Agent, or Firm*—Burns, Doane, Swecker & Mathis

[57] ABSTRACT

A material (1) in the form of sheets or a web is provided with a watermarklike pattern (12) in the form of a text, figure or similar identification mark visible or displayable in transmitted light by means of relieflike mechanical working off of material, for example grinding, milling etc., corresponding to the desired pattern (12).

4 Claims, 2 Drawing Figures

METHOD FOR THE MANUFACTURE OF A MATERIAL IN THE FORM OF SHEETS OR A WEB PROVIDED WITH A WATERMARKLIKE PATTERN

FIELD OF INVENTION

The present invention relates to a method for the manufacture of a material in the form of sheets or a web, in particular writing or document paper such as securities of the type of cheques, bank-notes etc., provided with marks detectable or made visible in transmitted light or radiation. The invention also relates to material in the form of sheets or a web manufactured in accordance with the method.

BACKGROUND OF THE INVENTION

The providing of writing and document paper with so-called watermarks has been known for a long time. Such watermarks in principle are invisible but appear clearly when the sheet of paper provided with watermark is held up against the light or light is transmitted through it in some other manner. Traditionally watermarks are produced by impressions in, or contact with, strongly hydrated paper pulp distributed on the screen of a paper machine. The operation is carried out with the help of a so-called dandy roll.

Such watermarks are expensive to produce if the watermarked material is not to be manufactured in large quantities. As a rule, it is not economically justifiable to provide private note-paper with special watermarks using this prior practice.

However, there is a possiblity of producing so-called false watermarks (marks of watermark character detectable or made visible in transmitted light or radiation) in a chemical manner. These "watermarks" are produced in that the optical refractive index of the paper is altered locally by applying a chemical substance, for example a polymerizable substance, to the paper in the desired pattern. However, it has been found that these false watermarks are often quite visible without any transmittance of light and that they give the impression of a "grease mark" having been made on the paper.

OBJECTS AND SUMMARY OF THE INVENTION

The abovementioned methods are subject to disadvantages which can be avoided with the present invention which is characterized in that desirable watermarklike markings are produced by differentiated working off of material from a web to provide a graded reduction of thickness forming a text or a picture.

BRIEF DESCRIPTION OF THE DRAWING

The invention will be described in the following with reference to the attached schematic drawing wherein.

DETAILED DESCRIPTION OF THE PREFERRED EMBODIMENT

A watermark of the type not directly visible has been used for a long time as a proof of legitimacy of documents and securities such as bank-notes, share-certificates, etc. Marking of this type has also been used to identify the manufacturer of a paper, on business note-paper and to a certain limited extent for private note-paper, mainly hand-made paper. The reason why the marking of machine-manufactured private note-paper with watermarks is not economically justifiable is that with the prior methods it is not worthwhile to manufacture less than approximately ten tons of paper with a marking.

The method in accordance with the present invention makes it possible to produce in an economic manner private note-paper, business paper and document paper in substantially smaller quantities than if traditional watermarking were to be used. It is a further advantage that the marking can be placed on the individual paper sheets with considerably greater precision and that the contours of the marking will be more distinct.

Figure 1:
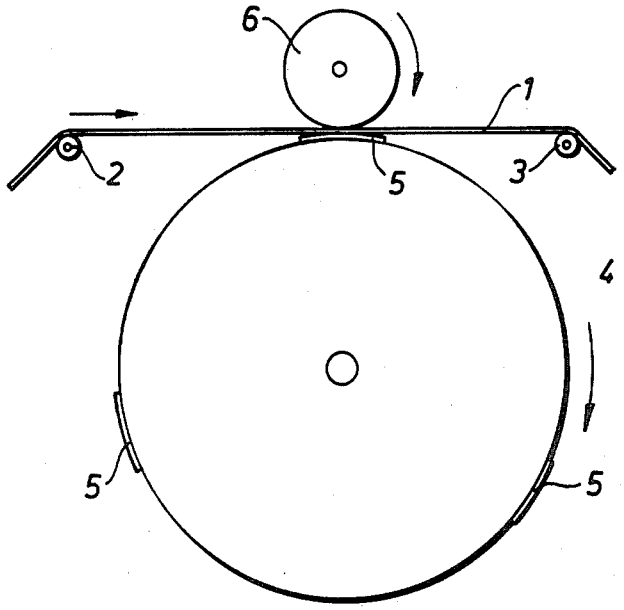
FIG. 1 is a side view of an apparatus for providing a paper web with a watermarklike pattern in accordance with a preferred method of the present invention and FIG. 2 is an enlargement of the area surrounded by broken lines in FIG. 1.

Referring to FIG. 1, a paper web 1 is provided with watermarklike pattern. The paper web is fed over deflection rollers 2 and 3 and a matrix roll 4. The matrix roll 4 has local projections (matrices) 5 which rest against the regions of the web which are to be provided with the said pattern. As indicated in FIG. 1 the matrix roll 4 rotates in the direction of the paper web at the same speed as the latter so that slipping between the roll 4 and the web 1 is avoided. Adjoining the roll 4 a grinding roller 6 is arranged at such an adjustable distance from the roll 4 that parts of the paper web 1 which rest against the surface of the roll can narrowly pass the gap between the grinding roller 6 and the roll 4. This obviously means that no grinding occurs on these parts of the web 1. FIG. 1 further shows that the grinding roller 6 is smaller than the roll 4 and that it is adapted to rotate in the direction toward the roll 4. The grinding roller 6 is rotated at a speed which is higher, preferably substantially higher, than the speed of rotation of the roll 4.

Figure 2:
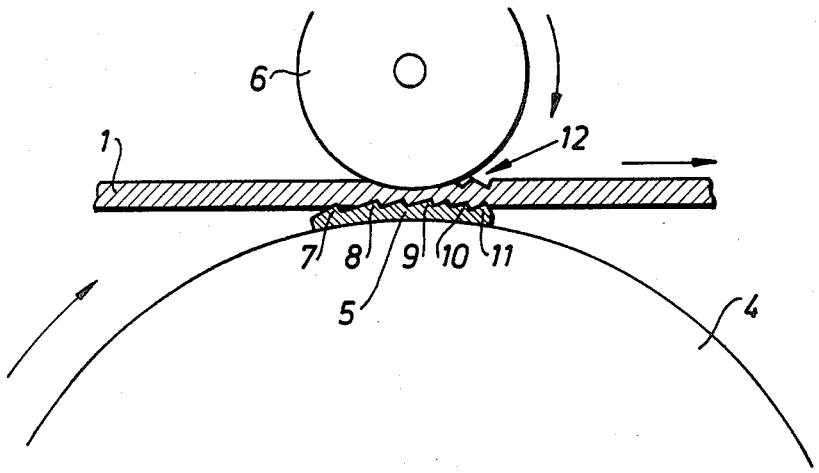

FIG. 2 illustrates in greater detail how the local projections 5 on the material roll 4 can be constituted of mutually adjoining or interconnecting portions 7–11 with points located at different heights above the surface of the roll 4 thus forming a relieflike surface structure which corresponds to the desired pattern. When the matrix roll 4 passes a projection 5 passes along the grinding roll 6, a part of the paper web 1 will be raised toward the grinding roll 6 and, the part so raised is ground away in a graded manner. Thus in the web 1 a "grinding image" (partly appearing at 12) is obtained which in shape, height and position substantially corresponds to the projections 5. On inspecting this grinding image in transmitted light, a watermarklike pattern of mutually adjoining or interconnecting portions of varying degree of light admittance will be visible on the paper web 1.

The local projections 5 can be produced, for example, from any suitable lasting material such as steel.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A method of manufacturing a material web having a predetermined watermarklike pattern, said method comprising the steps of imprinting a relieflike matrix corresponding to said pattern against one side of said web, and removing material from raised regions on the opposite side of said web overlying said matrix, whereby said pattern having mutually adjoining positions of different thickness and degree of light transmittance are formed in said material web, said removing step includes placing the web between said relieflike matrix conforming with said predetermined pattern and a rotating grinding roller, whereby material is removed along the regions as the regions are pressed against said roller by said matrix.

2. The method in accordance with claim 1, wherein said placing step includes feeding the material web in a first direction through a gap between the grinding roller and a roll adjacent said grinding roller, said roll on its surface carrying said matrix, said roll adapted to rotate in the first direction of feed of the material web, a gap between the grinding roller and the surface of the roll being at least equal to a thickness of the paper web, a second gap formed between the grading roller and the highest point of the relieflike matrix surface in relation to the surface of the roll, whereby grinding of holes entirely through the material web is avoided.

3. The method in accordance with claim 2, wherein the material web includes paper and the grinding roller is rotated in a direction opposite of the direction of feed of the paper web and at a higher speed than that of said roll.

4. The method in accordance with claim 2, wherein the roll is rotated such that a peripheral speed of the roll substantially equals a speed of feed of the material web.

* * * * *